US008079105B2

(12) United States Patent
Squires et al.

(10) Patent No.: US 8,079,105 B2
(45) Date of Patent: Dec. 20, 2011

(54) CARD CLEANING MECHANISM

(75) Inventors: Milo B. Squires, Chaska, MN (US); Timothy J. Flitsch, Lakeville, MN (US)

(73) Assignee: DataCard Corporation, Minnetonka, MN (US)

( * ) Notice: Subject to any disclaimer, the term of this patent is extended or adjusted under 35 U.S.C. 154(b) by 1257 days.

(21) Appl. No.: 11/557,212

(22) Filed: Nov. 7, 2006

(65) Prior Publication Data

US 2007/0143937 A1 Jun. 28, 2007

Related U.S. Application Data

(60) Provisional application No. 60/735,636, filed on Nov. 10, 2005.

(51) Int. Cl.
*B08B 1/02* (2006.01)

(52) U.S. Cl. ..... 15/3; 15/102; 15/103.5; 15/256.51

(58) Field of Classification Search ..... 15/3, 102, 15/103.5, 256.51; 347/171, 214, 215, 217–219, 347/32; 439/159
See application file for complete search history.

(56) References Cited

U.S. PATENT DOCUMENTS 5,239,926 A * 8/1993 Nubson et al. ..... 101/487
5,401,111 A 3/1995 Nubson et al.
5,588,763 A * 12/1996 Nubson et al. ..... 400/700
5,833,171 A * 11/1998 Harris ..... 242/615.1
5,855,037 A * 1/1999 Wieloch et al. ..... 15/256.5
5,913,345 A * 6/1999 Corrado et al. ..... 15/3
6,401,287 B1 * 6/2002 Corrado et al. ..... 15/3
6,582,141 B2 6/2003 Meier et al.
2003/0201317 A1 * 10/2003 Shay et al. ..... 235/375
2005/0005249 A1 3/2005 Helma et al.

FOREIGN PATENT DOCUMENTS

CN 1602652 A 3/2005
EP 1245299 10/2002
JP 2000-313153 11/2000
WO WO 2005/011883 2/2005

OTHER PUBLICATIONS

PCT International Search Report for corresponding International Application No. PCT/US2006/060741.
Office Action issued Jun. 26, 2009 by the States Intellectual Property Office of the People's Republic of Chine in related application No. CBN 200680042174.8.—*Translation only submitted*—.
Supplementary European Search Report issued Aug. 17, 2009 by the European Patent Office in related European Application Number 06 84 6268.

* cited by examiner

*Primary Examiner* — Robert Scruggs
(74) *Attorney, Agent, or Firm* — Hamre, Schumann, Mueller & Larson, P.C.

(57) ABSTRACT

A cleaning mechanism for cleaning one or both side surfaces of a plastic card substrate prior to a processing operation occurring on the cleaned side surface. The cleaning mechanism is designed so that two cleaning rollers, one cleaning roller on a first cleaning station and one cleaning roller on a second cleaning station, are simultaneously cleaned by a single cleaning tape assembly.

18 Claims, 4 Drawing Sheets

CARD CLEANING MECHANISM

CROSS-REFERENCE TO RELATED APPLICATIONS

The present application claims the benefit of U.S. Provisional Patent Application Ser. No. 60/735,636 entitled "CARD CLEANING MECHANISM," filed on Nov. 10, 2005, which is herewith incorporated by reference in its entirety.

FIELD OF THE INVENTION

The invention relates to a cleaning mechanism for cleaning one or both side surfaces of a plastic card substrate prior to a processing operation, for example a personalization process, occurring on the cleaned side surface.

BACKGROUND OF THE INVENTION

Card personalization systems and methods used in producing personalized cards and other personalized identity documents have been employed by institutions that issue such documents. Identity documents which are often personalized by such systems and methods includes plastic and composite cards, such as financial (e.g. credit and debit) cards, drivers' licenses, national identification cards, and other cards and documents which are personalized with information unique to the intended document holder.

For large volume, batch production of cards, institutions often utilize systems that employ multiple processing modules to process multiple cards at the same time and reduce the overall per card processing time. Examples of such systems include the system disclosed in U.S. Pat. No. 6,902,107, the DataCard MaxSys and 9000 series systems available from DataCard Corporation of Minneapolis, Minn., the system disclosed in U.S. Pat. No. 4,825,054, and the system disclosed in U.S. Pat. No. 5,266,781 and its progeny.

Common to each of these types of systems is an input with the ability to hold a relatively large number of cards that are to be processed, a plurality of processing modules through which each card is directed to perform a processing operation, and an output that holds the resulting processed cards. Processing operations that are typically performed on the cards include the programming of data onto a magnetic stripe of the card, monochromatic and/or color printing, laser processing, programming an integrated circuit chip in the card, embossing, and applying various topcoat and protective layers. A controller is typically employed to transfer data information and instructions for operating the input, the processing stations, and the output.

In the case of a card, the processing operations are often performed on one or both generally planar side surfaces of the card. The processing operations that are performed include processes such as the application of data and/or graphic images on one or more of the side surfaces, for example using known printing processes. Additional processing operations that are performed also include the application of laminates and coatings to the card side surfaces.

Often times, a card may contain contaminants on one, or both, of its generally planar side surfaces. Examples of contaminants typically found on card surfaces include dust, particles, fibers, and oils. These contaminants can result from a number of causes, for example the card production technique used to produce the card, or improper care and/or storage of card stock. It is known that contaminants on a planar card surface will negatively impact many processing operations that are performed on the card surface, for example monochromatic and multi-color printing processes.

As a result, a card is often cleaned prior to a processing operation in order to remove contaminants. The use of a cleaning mechanism to clean one or more side surfaces of a card is known. Some conventional cleaning mechanisms include a pair of cleaning rollers that have tacky outer surfaces and between which a card is passed to remove contaminants from each side surface of the card. The contaminants are thereafter removed from the cleaning rollers using cleaning tape that is brought into contact with the cleaning rollers to strip or remove the contaminants from the rollers. The cleaning tape is typically provided from a supply roll, and after stripping contaminants from the tacky outer surfaces of the rollers, is wound onto a take-up roll. Examples of known cleaning mechanisms are disclosed in U.S. Pat. Nos. 5,401,111 and 6,902,107.

SUMMARY OF THE INVENTION

The invention relates to a cleaning mechanism for cleaning one or both side surfaces of a card substrate prior to a processing operation occurring on the cleaned side surface. The cleaning mechanism can be part of a cleaning module that forms one module of a modular card processing system. Alternatively, the cleaning mechanism can be incorporated into a different processing module with other card processing equipment, and can be used in a non-modular system.

The cleaning mechanism is designed so that two cleaning rollers, one cleaning roller on a first cleaning station and one cleaning roller on a second cleaning station, are simultaneously cleaned by a single cleaning tape assembly.

In one aspect of the invention, a card cleaning mechanism includes first and second cleaning roller assemblies. Each cleaning roller assembly includes a pair of cleaning rollers rotatably mounted on a turret body for rotation about respective longitudinal axes, with each cleaning roller including a tacky outer surface. The turret body is rotatable about a central longitudinal axis extending parallel to the longitudinal axes of the cleaning rollers. In addition, a cleaning tape assembly is positioned adjacent the first and second cleaning roller assemblies, with the cleaning tape assembly being configured to remove contaminants from the tacky outer surfaces of the cleaning rollers of each of the first and second cleaning roller assemblies.

In another aspect of the invention, a card cleaning module is provided that includes a card input through which a card to be cleaned is input into the module, an input drive mechanism adjacent the card input for receiving a card through the card input and driving the card further into the module, a card output through which a cleaned card is output from the module, and an output drive mechanism adjacent the card output for driving the cleaned card out of the module. First and second cleaning stations are disposed between the card input and the card output. The first and second cleaning stations each include a pair of cleaning rollers rotatably mounted for rotation about respective longitudinal axes and defining a nip therebetween through which the card passes. Each cleaning roller includes a tacky outer surface. In addition, a cleaning tape assembly is positioned adjacent the first and second cleaning stations, with the cleaning tape assembly being configured to remove contaminants from the tacky outer surfaces of the cleaning rollers of each of the first and second cleaning stations.

In yet another aspect of the invention, a card cleaning mechanism is provided that includes a cleaning roller assembly having a pair of cleaning rollers rotatably mounted for rotation about respective longitudinal axes and defining a nip therebetween through which a card passes for cleaning. Each cleaning roller includes a tacky outer surface. In addition, a cleaning tape assembly is positioned adjacent the cleaning roller assembly and is configured to remove contaminants from the tacky outer surfaces of the cleaning rollers. The cleaning tape assembly includes a backing roller having first and second ends, and the backing roller is supported by a bearing proximate the center of the backing roller between the first and second ends, and the backing roller is not supported by bearings at the first and second ends.

This configuration of the backing roller allows the backing roller to maintain consistent contact along the full length of the cleaning rollers, which is necessary for complete cleaning of the cleaning rollers. The backing roller is able to pivot in two planes independently using the angular play in the bearing. This gives the backing roller the freedom to match the angular position of both cleaning rollers so that the backing roller self-aligns to both cleaning rollers independently. This reduces the need for using high tolerance parts on the cleaning stations, saves time in assembly, and increases the reliability of the cleaning function.

In yet another aspect of the invention, a card cleaning mechanism is provided that includes a cleaning roller assembly having a pair of cleaning rollers rotatably mounted for rotation about respective longitudinal axes and defining a nip therebetween through which a card passes for cleaning. Each cleaning roller includes a tacky outer surface. In addition, a cleaning tape assembly is positioned adjacent the cleaning roller assembly and is configured to remove contaminants from the tacky outer surfaces of the cleaning rollers. The cleaning tape assembly includes a supply roll of cleaning tape, an idler roller that rides against the surface of the supply roll, and an arm on which the idler roller is supported, the arm being pivotally mounted so that the idler roller can move toward the supply roll as the diameter of the supply roll decreases, and the arm is biased to move away from the supply roll.

The idle roller causes the cleaning tape to peel smoothly and consistently from the supply roll as a drive roller pulls out cleaning tape from the supply roll. This reduces noise and erratic supply roll motion (jumping) that tends to cause unreliable sensor readings.

DRAWINGS

DETAILED DESCRIPTION

The invention relates to a cleaning mechanism for cleaning one or both side surfaces of a plastic card substrate prior to a processing operation occurring on the cleaned side surface. The cleaning mechanism will be described herein as being part of a cleaning module that forms one module of a central issuance, modular card processing system. However, the cleaning mechanism can be incorporated into a different processing module with other card processing equipment, and can be used in a non-modular system.

Figure 1:
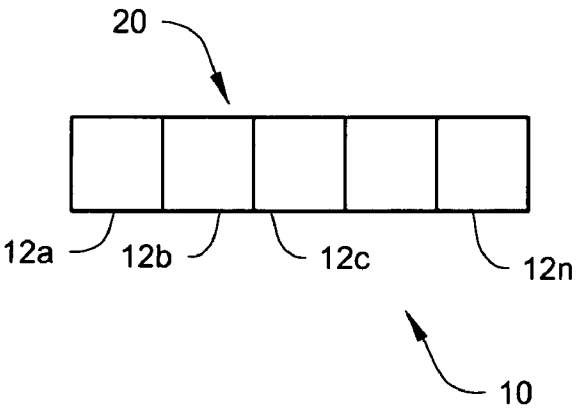
FIG. 1 is a schematic depiction of a modular card processing system.

An example of a modular card processing system 10 is schematically depicted in FIG. 1. The system 10 is configured for large volume, batch production of cards by employing multiple processing modules 12*a*, 12*b*, 12*c* . . . 12*n* to process multiple cards at the same time to reduce the overall per card processing time. Examples of processing modules 12*a*, 12*b*, 12*c* . . . 12*n* that may be included in the system 10 are a magnetic stripe module for writing data to and reading data from a magnetic stripe on the cards, an embossing module for forming embossed characters on the cards, a smart card programming module for programming an integrated circuit chip on the cards, a printer module for performing monochromatic or multi-color printing, a laser module for performing laser personalization on the cards, a graphics module for applying monochromatic data and images to the cards, a cleaning module (described below) for cleaning the cards, a topping module for applying a topcoat to the cards, and a card punching module to punch or cut a hole into the cards and/or to punch the card into a specific shape. The system 10 also typically includes an input module that holds a plurality of cards to be processed, and an output module that holds processed cards.

Further information on the construction and operation of a modular card processing system can be found in U.S. Pat. No. 6,902,107, which is herein incorporated by reference in its entirety.

One of the modules in the system 10 is a cleaning module 20 according to the invention that is designed to clean both sides of a card in order to remove contaminants from the side surfaces of the card. Contamination, for example foreign particles, dirt and oil, on the side surfaces of the card can interfere with a processing task. For example, in a personalization process performed by another module, contaminants can degrade the resulting quality of the personalization. The cleaning module 20 is preferably located in the system 10 before the graphics module (if used), the printer module (if used) and the laser module (if used), because the tasks performed by these modules are particularly susceptible to card contamination. However, the cleaning module 20 could be located at any location in the system 10 downstream from the input module. In addition, the system 10 could utilize more than one cleaning module.

Figure 2:
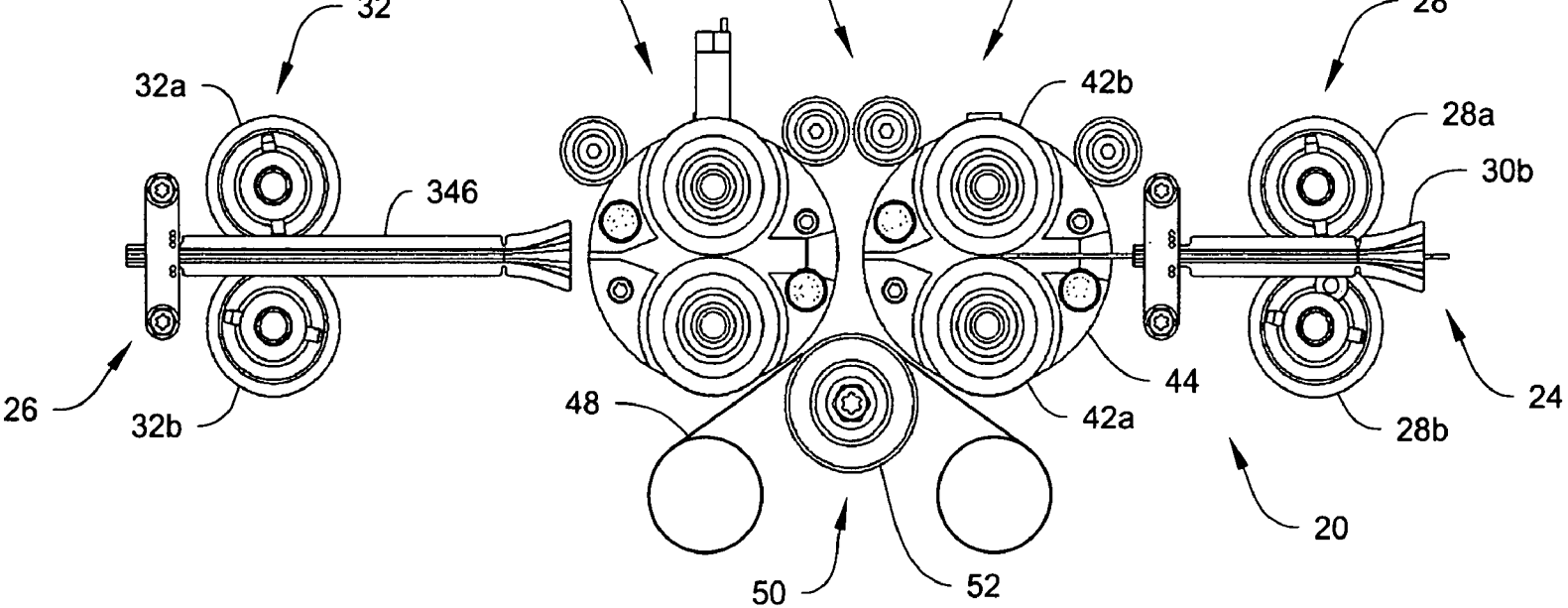
FIG. 2 shows a card cleaning mechanism according to the invention.
Figure 5:
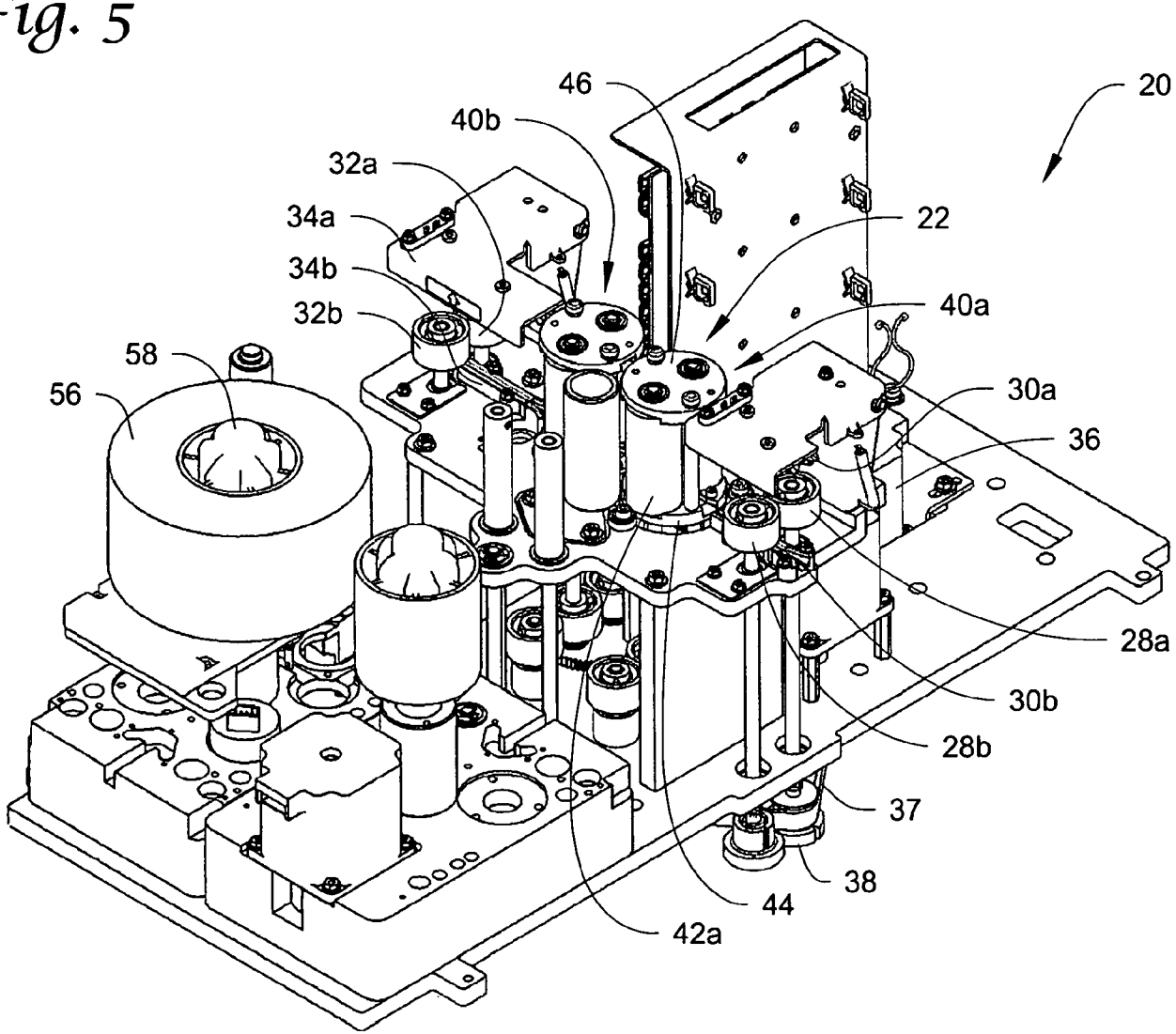
FIG. 5 is a perspective view of the card cleaning mechanism.

With reference to FIGS. 2 and 5, an internal portion of the cleaning module 20 is illustrated including a card cleaning mechanism 22. The module 20 includes a card input 24 through which a card to be cleaned is input into the module 20, and a card output 26 through which a cleaned card is output from the module 20.

An input drive mechanism 28 in the form of a pair of input rollers 28*a*, 28*b* is provided adjacent the card input 24 to receive cards from an upstream module and drive the cards into the cleaning mechanism 22. Upper and lower input guides 30*a*, 30*b* help guide the cards into the nip between the rollers 28*a*, 28*b* and define upper and lower card tracks that define a card path leading to the cleaning mechanism 22. An output drive mechanism 32 in the form of a pair of output rollers 32*a*, 32*b* is provided adjacent the card output 26 for driving cleaned cards from the cleaning module to the next module. An upper card guide 34*a* and a lower card guide 34*b* guide the cards as they exit the cleaning mechanism 22 and define a card path leading to the output 26 of the module 20. The input rollers 28*a*, 28*b* and the output rollers 32*a*, 32*b* are driven by an electric motor 36, for example a stepper motor, via a drive belt 37 and pulley 38 for the rollers 28*a*, 28*b*, and a similar drive belt and pulley (not shown) for the rollers 32*a*, 32*b*.

As shown in FIGS. 2 and 5, the illustrated cleaning mechanism 22 includes first and second card cleaning stations 40*a*, 40*b* disposed between the card input 24 and the card output 26. In the illustrated embodiment, each station 40*a*, 40*b* comprises a cleaning roller assembly that includes a pair of cleaning rollers 42*a*, 42*b* that define a nip therebetween through which a card passes to be cleaned. The cleaning mechanism 22 could include additional cleaning stations, for example a third cleaning station or third and fourth cleaning stations, which could utilize the same cleaning tape assembly discussed below and one or more additional backing rollers.

The stations 40*a*, 40*b*, in the illustrated embodiment, are generally similar to each other, and each station 40*a*, 40*b* is similar to the cleaning roller assembly described in U.S. Pat. No. 6,902,107. Only the station 40*a* will be described in detail, it being understood that the station 40*b* is constructed, and operates, in a similar manner as station 40*a*.

Cards pass through the nip of the cleaning rollers 42*a*, 42*b* so that the roller 42*a* contacts one side of the card and the roller 42*b* contacts the other side of the card. The outer surfaces of the cleaning rollers 42*a*, 42*b* are tacky or sticky so that contaminants on the card surfaces are picked up by, and adhere to, the cleaning rollers. The use of cleaning rollers having tacky outer surfaces is described in U.S. Pat. No. 5,401,111. The circumference of each roller 42*a*, 42*b* is selected so as to be approximately equal to or greater than the length of the card. For example, the rollers 42*a*, 42*b* can each have a circumference of about 3.14 inches (about 79.76 mm), and the card can have a length of about 3.375 inches (about 85.725 mm). This minimizes or eliminates that portion of the rollers outer surface that would contact the card, make one full revolution, and contact the card again.

With reference to FIGS. 2 and 5, the cleaning rollers 42*a*, 42*b* are mounted for rotation on a turret body that includes a lower turret plate 44 and an upper turret plate 46. Each turret plate defines a track therein for guiding the upper and lower edges of the cards as the cards travel through the rollers 42*a*, 42*b*. A suitable drive mechanism is connected to the rollers 42*a*, 42*b* for driving the rollers in synchronous, opposite rotation. Preferably, the rotation of the cleaning rollers 42*a*, 42*b* is synchronized with, and at the same rotational speed as, the rotation of the input rollers 28*a*, 28*b* and the output rollers 32*a*, 32*b*. Therefore, as a card is driven by the input rollers 28*a*, 28*b* into the cleaning rollers 42*a*, 42*b*, and from the cleaning rollers into the output rollers 32*a*, 32*b*, a smooth transition of the card is achieved.

The turret body comprising the upper turret plate 46 and the lower turret plate 44 is rotatable about a central longitudinal axis through the center of the plates, with the axis extending parallel to the longitudinal axes of the cleaning rollers 42*a*, 42*b*. The cleaning rollers 42*a*, 42*b*, which are rotatably mounted on the turret plates, rotate with the turret plates. As described in U.S. Pat. No. 6,902,107, rotation of the turret body is used to disengage the drive connection between a drive wheel and a driving wheel, and to position the cleaning rollers 42*a*, 42*b* for subsequent engagement by a cleaning tape 48 to remove contaminants from the cleaning rollers. The turret body is rotated by an electric motor, for example a stepper motor, through a suitable drive mechanism, such as gears. An example of a mechanism for rotating a turret body is disclosed in U.S. Pat. No. 5,401,111.

A tab that is positioned below the upper turret plate is sensed by a sensor to determine a home position of the turret body. The home position of the turret body of the station 40*a* is illustrated in FIG. 2. Removal of contaminants from the cleaning rollers 42*a*, 42*b* occurs by rotating the turret body either clockwise or counterclockwise from the home position. Preferably, the turret body is rotated to a first cleaning position so that contaminants can be removed from the cleaning roller 42*a*, and rotated to a second cleaning position to remove contaminants from the cleaning roller 42*b*.

The second station 40*b* is disposed downstream from the first station 40*a*, and is generally similar in construction to the first station 40*a*. The cleaning rollers 42*a*, 42*b* of the second station 40*a* are driven by the same drive mechanism that drives the cleaning rollers of the first station. Likewise, the turret body of the second station 40*b* is driven by the same motor and drive mechanism used to drive the turret body of the first station 40*a*, and the same sensing mechanism that is used to sense the home position of the turret body of the first station 40*a* is used to sense the home position of the turret body of the second station 40*b*. Therefore, no extra active elements are needed to support operation of the second station 40*b*.

With reference to FIG. 2, a single cleaning tape assembly 50 that includes the cleaning tape 48 is positioned adjacent both of the stations 40*a*, 40*b* so as to be shared between the two stations 40*a*, 40*b* and the cleaning rollers of the stations 40*a*, 40*b* are cleaned using the same portion of cleaning tape 48. The cleaning tape assembly 50, which is shown schematically in FIG. 2, is generally similar in construction and operation to the cleaning tape assembly disclosed in U.S. Pat. No. 6,902,107.

Figure 3:
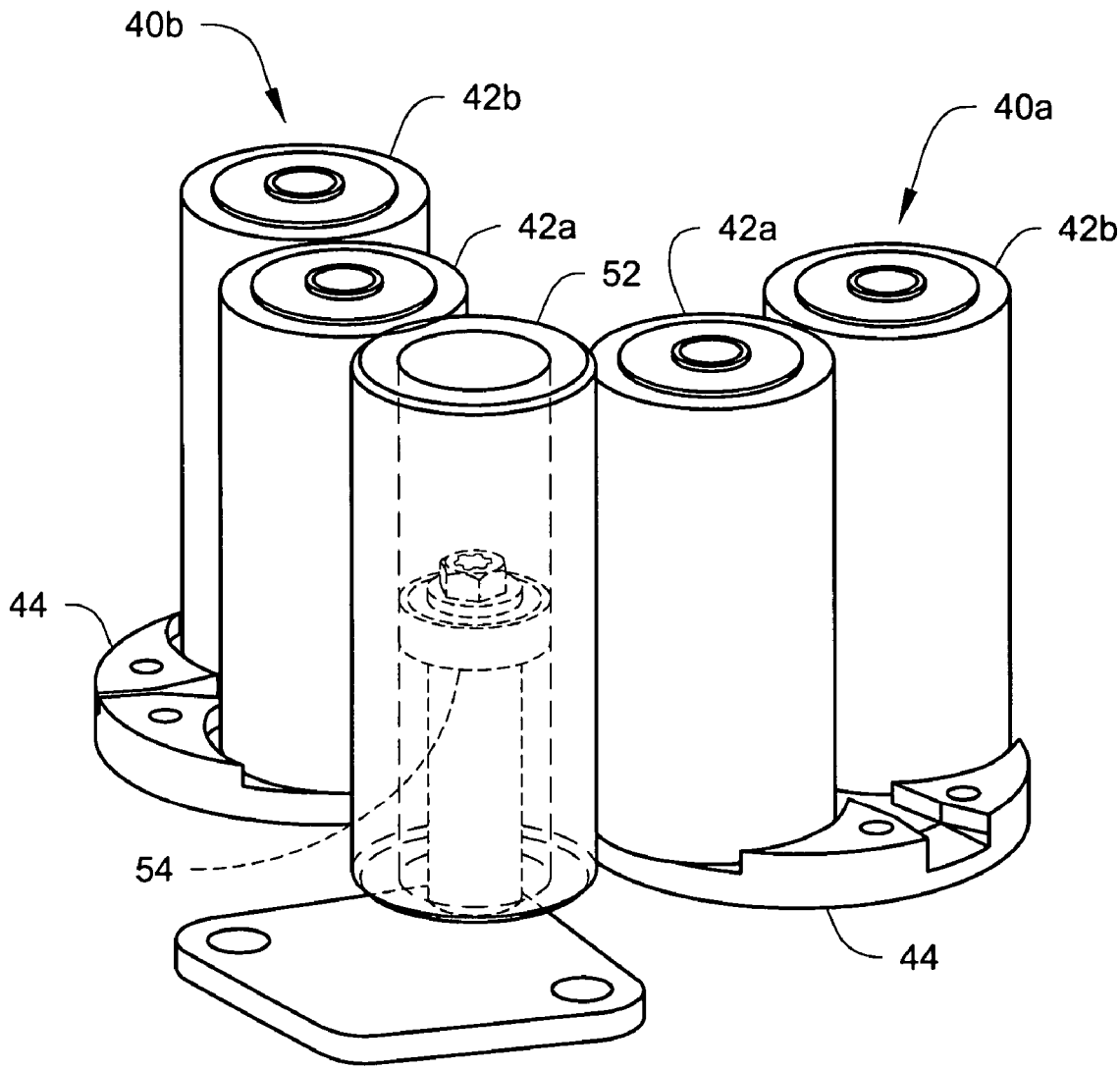
FIG. 3 shows the construction of a backing roller used in a cleaning tape assembly of the card cleaning mechanism.

With reference to FIGS. 2 and 3, the cleaning rollers 42*a*, 42*b* are cleaned by running the cleaning tape 48 against their outer surfaces to remove accumulated debris. A backing roller 52 of the cleaning tape assembly 50 presses the cleaning tape against the rollers during cleaning.

Consistent contact along the full length of the cleaning rollers is necessary for complete cleaning. Any gap between the cleaning rollers and the backing roller 52 will result in debris remaining on the cleaning rollers. The cleaning tape assembly 50 is positioned so that two cleaning rollers, one cleaning roller on the station 40*a* and one cleaning roller on the station 40*b*, are cleaned at the same time and the backing roller 52 must maintain contact with each cleaning roller during the cleaning cycle. Because the backing roller is fixed in position (i.e. the backing roller does not move toward or away from the cleaning rollers), all three of the rollers (two cleaning and one backing roller) need to be generally parallel to each other for continuous tape contact. Any variation in angle or shape of the rollers would result in gaps between the rollers.

As shown in FIG. 3, the backing roller 52 is not supported by bearings at its top and bottom, but by a single bearing 54 at approximately mid-height. This design allows the backing roller 52 to pivot in two planes independently using the angular play in the bearing. This gives the backing roller 52 the freedom to match the angular position of both cleaning rollers so that the backing roller self-aligns to both cleaning rollers independently. This reduces the need for using high tolerance parts on the stations 40*a*, 40*b*, saves time in assembly, and increases the reliability of the cleaning function.

Figure 4:
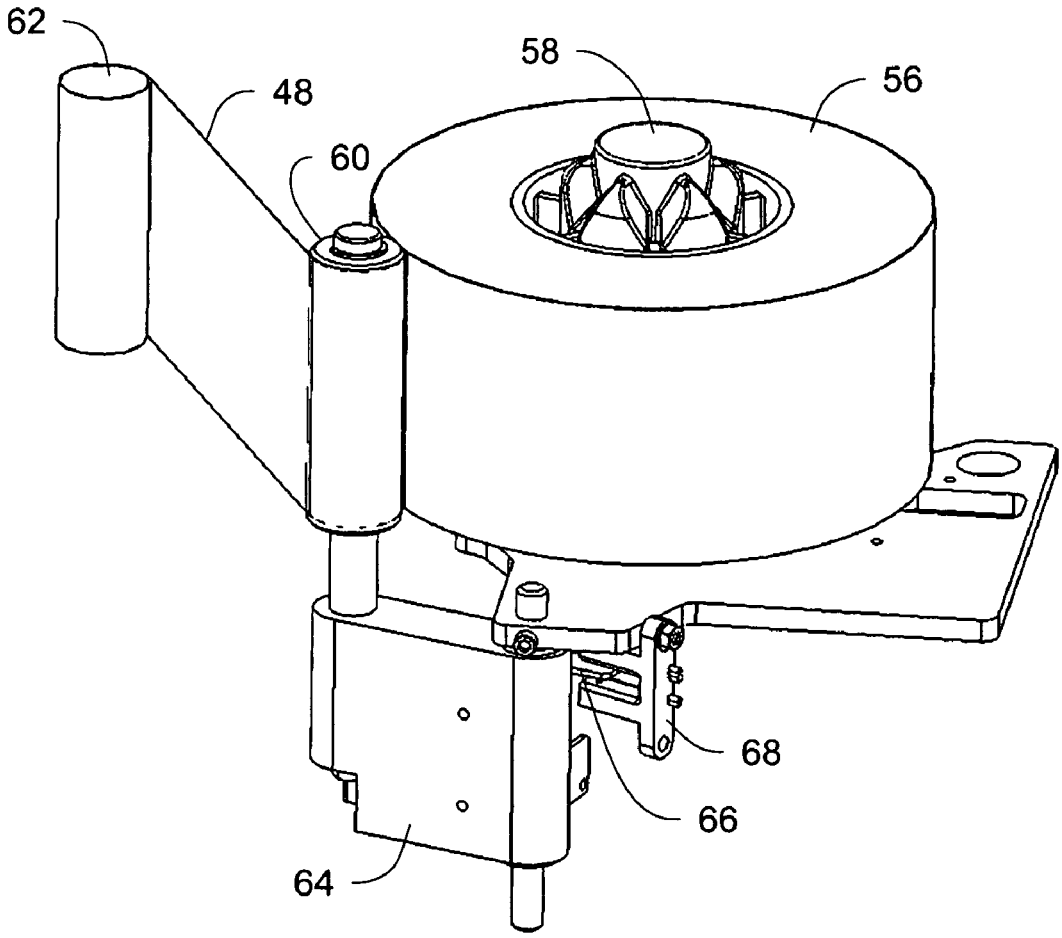
FIG. 4 shows the construction of a mechanism for controlling the stripping of cleaning tape from a supply roll in the cleaning tape assembly of the card cleaning mechanism.

With reference to FIG. 4, along with FIG. 5, the cleaning tape assembly 50 also includes a supply roll 56 containing a supply of the cleaning tape 48. The supply roll 56 is disposed on a non-driven, rotatable spindle 58 which rotates when the cleaning tape 48 is pulled from the roll 56. An encoder is connected to the spindle shaft to detect supply roll rotation and predict the amount of cleaning tape remaining on the roll. Due to the stickiness of the cleaning tape 48, the cleaning tape 48 has a tendency to peel from the supply roll 56 in an uneven or jerky manner. This can cause the encoder to obtain unreliable readings of the supply roll rotation.

The cleaning tape assembly 50 includes a mechanism that produces a smooth or even peeling of the tape from the supply roll at a tangent point on the roll, thereby reducing noise and erratic supply roll motion (jumping) that tends to cause unreliable sensor readings. In particular, the mechanism includes an idler roller 60 that rides against the surface of the supply roll 56, as shown in FIG. 4. As the cleaning tape 48 is peeled from the supply roll 56 at the tangent point, the tape 48 wraps partially around the idler roller 60, and then travels toward a knurled drive roller 62 that assists in advancing the tape 48 past the cleaning rollers during cleaning.

The idler roller 60 is supported on a pivoting arm 64 that is mounted to allow the idler roller 60 to move toward the supply roll's core as the diameter of the supply roll decreases. In addition, the arm 64 is lightly spring loaded to move away from the supply roll 56. Tension in the cleaning tape and the manner in which the cleaning tape 48 wraps partially around the idler roller 60 maintains the idler roller in contact with the supply roll 56 during normal operation. A tab 66 is connected to the arm 64 and moves therewith, and a sensor 68 detects movement of the tab 66.

The idle roller 60 causes the tape 48 to peel smoothly and consistently from the roll 56 as the drive roller 62 pulls out tape. The tension in the tape maintains the idler roller 60 in contact with the supply roll 56. Upon removal of the tension in the tape, such as when the cleaning tape breaks, the spring loading of the arm 64 will cause the idler roller 60 to move away from the roll 56. If the idler roller 60 and arm 64 move far enough away from the roll 56, the tab 66 will no longer be sensed by the sensor 68. As a result, the arm 64 can also be used to sense a break in the cleaning tape 48.

The operation of the cleaning module 20 and cleaning mechanism 22 will now be described. A card is input into the module 20 from an upstream module and the input rollers 28*a*, 28*b* then drive the card into the first cleaning station 40*a*. The card passes between the cleaning rollers 42*a*, 42*b* which pick up contaminants from the side surfaces of the card. The card then enters the second cleaning station 40*b* and passes between the cleaning rollers 42*a*, 42*b* which pick up additional contaminants from the side surfaces of the card. The cleaned card is then picked up by the output rollers 32*a*, 32*b* which drive the card from the cleaning module 20 to the adjacent downstream module for subsequent processing.

After the card is cleaned, the turret body of the cleaning station 40*a* is rotated in a clockwise direction while the turret body of the cleaning station 40*b* is rotated in a counterclockwise direction. This disengages the cleaning roller drive mechanism and brings the cleaning roller 42*a* of each cleaning station 40*a*, 40*b* into position ready for cleaning.

The cleaning tape is then pulled across the outer surfaces of the cleaning rollers 42*a*. After the surfaces of the cleaning rollers 42*a* are cleaned, the cleaning stations rotate back to their home positions and another card is passed through the rollers for cleaning. After the second card is cleaned, the turret body of the station 40*a* is rotated in a counterclockwise direction and the turret body of the station 40*b* is rotated in a clockwise direction to position the cleaning rollers 42*b* in position for cleaning. In this position the cleaning tape 48 contacts the outer surfaces of the cleaning rollers 42*b* and the cleaning tape is pulled across the surfaces of the cleaning rollers 42*b* to clean the rollers. The cleaning stations then rotate back to their home positions ready for another card to be cleaned.

It has been found that cleaning only one set of rollers, i.e. the rollers 42*a* or the rollers 42*b*, after each card is cleaned increases card throughput, as this minimizes the amount of movement of each turret body between cards. At the same time, acceptable card cleaning is achieved. If desired, both sets of rollers 42*a*, 42*b* could be cleaned one after the other between cards.

The use of two cleaning stations results in improved card cleaning even when less expensive cleaning tape is used, while avoiding the need for a second cleaning tape assembly.

The invention claimed is:

1. A card cleaning mechanism, comprising:

first and second cleaning roller assemblies, each cleaning roller assembly including:

a pair of cleaning rollers rotatably mounted on a turret body for rotation about respective longitudinal axes, each cleaning roller including a tacky outer surface, and the turret body being rotatable about a central longitudinal axis extending parallel to the longitudinal axes of the cleaning rollers;

the first cleaning roller assembly and the second cleaning roller assembly rotatable simultaneously in opposite directions; and a cleaning tape assembly, the cleaning tape assembly having a backing roller, a cleaning tape and a cleaning tape supply roll, the cleaning tape assembly positioned so that the backing roller is adjacent the first and second cleaning roller assemblies, the cleaning tape assembly being configured to remove contaminants from the tacky outer surfaces of the cleaning rollers of each of the first and second cleaning roller assemblies.

2. The card cleaning mechanism of claim 1, wherein each pair of cleaning rollers define a nip therebetween through which a card being cleaned passes.

3. The card cleaning mechanism of claim 1, wherein each cleaning roller has a circumference that is approximately equal to or greater than the length of a card being cleaned.

4. The card cleaning mechanism of claim 1, wherein the cleaning tape assembly is positioned relative to the first and second cleaning roller assemblies so that the cleaning tape assembly is able to simultaneously remove contaminants from the tacky outer surface of one of the cleaning rollers of each of the first and second cleaning roller assemblies.

5. The card cleaning mechanism of claim 1, wherein the backing roller has first and second ends, and wherein the backing roller is supported by a bearing proximate the center of the backing roller between the first and second ends, and the backing roller is not supported by bearings at the first and second ends.

6. The card cleaning mechanism of claim 1, wherein the cleaning tape assembly comprises an idler roller that rides against the surface of the cleaning tape supply roll.

7. The card cleaning mechanism of claim 6, wherein the idler roller is supported on an arm that is pivotally mounted so that the idler roller can move toward the cleaning tape supply roll as the diameter of the cleaning tape supply roll decreases, and wherein the arm is biased to move away from the cleaning tape supply roll.

8. The card cleaning mechanism of claim 1, wherein the backing roller is fixed so that the backing roller does not move toward or away from the cleaning rollers.

9. A card cleaning module, comprising:

a card input through which a card to be cleaned is input into the module;

an input drive mechanism adjacent the card input for receiving a card through the card input and driving the card further into the module;

a card output through which a cleaned card is output from the module;

an output drive mechanism adjacent the card output for driving the cleaned card out of the module;

a card cleaning mechanism disposed between the card input and the card output, the card cleaning mechanism includes:

first and second cleaning roller assemblies, each cleaning roller assembly including:

a pair of cleaning rollers rotatably mounted on a turret body for rotation about respective longitudinal axes and defining a nip therebetween through which the card passes, each cleaning roller including a tacky outer surface, and the turret body being rotatable about a central longitudinal axis extending parallel to the longitudinal axes of the cleaning rollers;

the first cleaning roller assembly and the second cleaning roller assembly rotatable simultaneously in opposite directions; and a cleaning tape assembly, the cleaning tape assembly having a backing roller, a cleaning tape and a cleaning tape supply roll, the cleaning tape assembly positioned so that the backing roller is adjacent the first and second cleaning roller assemblies, the cleaning tape assembly being configured to remove contaminants from the tacky outer surfaces of the cleaning rollers of each of the first and second cleaning roller assemblies.

10. The card cleaning module of claim 9, wherein each cleaning roller has a circumference that is approximately equal to or greater than the length of the card being cleaned.

11. The card cleaning module of claim 9, wherein the cleaning tape assembly is positioned relative to the first and second cleaning roller assemblies so that the cleaning tape is able to simultaneously remove contaminants from the tacky outer surface of one of the cleaning rollers of each of the first and second cleaning roller assemblies.

12. The card cleaning module of claim 9, wherein the backing roller has first and second ends, and the backing roller is supported by a bearing proximate the center of the backing roller between the first and second ends, and the backing roller is not supported by bearings at the first and second ends.

13. The card cleaning module of claim 9, wherein the cleaning tape assembly comprises an idler roller that rides against the surface of the cleaning tape supply roll.

14. The card cleaning module of claim 13, wherein the idler roller is supported on an arm that is pivotally mounted so that the idler roller can move toward the cleaning tape supply roll as the diameter of the cleaning tape supply roll decreases.

15. The card cleaning module of claim 13, wherein the idler roller is supported on an arm that is pivotally mounted wherein the arm is biased to move away from the cleaning tape supply roll.

16. The card cleaning module of claim 9, wherein the backing roller is fixed so that the backing roller does not move toward or away from the cleaning rollers.

17. A card cleaning mechanism, comprising:

a cleaning roller assembly including a pair of cleaning rollers rotatably mounted for rotation about respective longitudinal axes and defining a nip therebetween through which a card passes for cleaning, each cleaning roller including a tacky outer surface; and a cleaning tape assembly positioned adjacent the cleaning roller assembly and being configured to remove contaminants from the tacky outer surfaces of the cleaning rollers, wherein the cleaning tape assembly includes a backing roller having first and second ends, wherein the backing roller is fixed so that the backing roller does not move toward or away from the cleaning rollers, wherein the backing roller is supported by a bearing proximate the center of the backing roller between the first and second ends, and the backing roller is not supported by bearings at the first and second ends so that the backing roller matches an angular position of the cleaning rollers.

18. A card cleaning mechanism, comprising:

a cleaning roller assembly including a pair of cleaning rollers rotatably mounted for rotation about respective longitudinal axes and defining a nip therebetween through which a card passes for cleaning, each cleaning roller including a tacky outer surface; and a cleaning tape assembly positioned adjacent the cleaning roller assembly and being configured to remove contaminants from the tacky outer surfaces of the cleaning rollers, wherein the cleaning tape assembly includes a supply roll of cleaning tape, an idler roller that rides against the surface of the supply roll, and an arm on which the idler roller is supported, the arm being pivotally mounted so that the idler roller can move toward the supply roll as the diameter of the supply roll decreases, and the arm is spring biased to move away from the supply roll.

* * * * *